US008858116B2

(12) United States Patent
Lim

(10) Patent No.: US 8,858,116 B2
(45) Date of Patent: Oct. 14, 2014

(54) ROAD RESTORATION BLOCK

(76) Inventor: Sun Woo Lim, Gunpo-si (KR)

( * ) Notice: Subject to any disclaimer, the term of this patent is extended or adjusted under 35 U.S.C. 154(b) by 0 days.

(21) Appl. No.: 13/499,868

(22) PCT Filed: Oct. 26, 2010

(86) PCT No.: PCT/KR2010/007350

§ 371 (c)(1),
(2), (4) Date: Apr. 2, 2012

(87) PCT Pub. No.: WO2011/052952

PCT Pub. Date: May 5, 2011

(65) Prior Publication Data

US 2012/0237294 A1 Sep. 20, 2012

(51) Int. Cl.
*E01C 5/00* (2006.01)
*E01C 9/08* (2006.01)

(52) U.S. Cl.
CPC ..... *E01C 9/08* (2013.01); *E01C 2201/167* (2013.01)
USPC ..... 404/41

(58) Field of Classification Search
CPC ..... E01C 2201/02; E01C 2201/06; E01C 2201/16; E01C 2201/14; E01C 5/00; E01C 5/005; E01C 5/06; E04F 15/02; E04F 2201/023; E04F 2201/026; E04F 2201/0523; E04F 2201/042
USPC ..... 404/34, 40, 41; 52/592.1, 598, 599
See application file for complete search history.

(56) References Cited

U.S. PATENT DOCUMENTS

| | | | | |
|---|---|---|---|---|
| 123,445 | A * | 2/1872 | Beidel | 404/38 |
| 619,934 | A * | 2/1899 | Buchtel | 404/41 |
| 1,411,415 | A * | 4/1922 | Cooley | 404/40 |
| 1,509,659 | A * | 9/1924 | Luchich et al. | 404/41 |
| 2,493,470 | A * | 1/1950 | Tau | 165/9.4 |
| 2,780,150 | A * | 2/1957 | Cyrus | 264/261 |
| 3,236,991 | A * | 2/1966 | Graham et al. | 219/213 |
| 5,098,218 | A * | 3/1992 | Reese et al. | 404/35 |
| 6,705,797 | B1 * | 3/2004 | Wada | 404/38 |
| 2006/0231131 | A1 * | 10/2006 | Hain | 136/244 |
| 2006/0291196 | A1 * | 12/2006 | Benavente | 362/153.1 |
| 2010/0040844 | A1 * | 2/2010 | Larson | 428/203 |

FOREIGN PATENT DOCUMENTS

| | | |
|---|---|---|
| JP | 2009-243046 | 10/2009 |
| KR | 20-0233185 | 9/2001 |
| KR | 20-0370302 | 12/2004 |

* cited by examiner

*Primary Examiner* — Abigail A Risic
(74) *Attorney, Agent, or Firm* — Robert E. Bushnell, Esq.

(57) ABSTRACT

The present invention relates to a road restoration block for covering eliminated pavements during various road constructions conducted by eliminating some of or the entire existing road pavements, and more specifically, to a road restoration block, which can quickly and safely cover the eliminated pavements by providing blocks that are simply carried, disposed, and disassembled with strong coupling power to the upper part of the eliminated pavements so that people and cars may pass even when the constructions are in progress, thereby providing a safe and pleasant construction environment by preventing the traffic congestion caused by the constructions.

3 Claims, 18 Drawing Sheets

ROAD RESTORATION BLOCK

CLAIM OF PRIORITY

This application makes reference to, incorporates the same herein, and claims all benefits accruing under 35 U.S.C. §119 from applications filed in the Korean Intellectual Property Office on 26 Oct. 2009 and there duly assigned Serial No. 10-2009-0101692. Furthermore, this application makes reference to, incorporates the same herein, and claims all benefits accruing under 35 U.S.C. §365(c) of my PCT International application entitled ROAD RESTORATION BLOCK filed on 26 Oct. 2010 and duly assigned Serial. No. PCT/KR2010/007350.

TECHNICAL FIELD

The present invention relates to a road restoration block made from rubber, plastic, metal, concrete, asphalt concrete, a synthetic resin, etc., and in particular to a road restoration block which is characterized in that during a construction such as a water and sewage facility construction, a gas supply pipe construction, an electric power supply cable burial construction and a communication facility construction so as to bury a conduit, a cable, a certain structure such as a manhole or something underground by cutting and removing part or all of a paved section of a road, it makes it possible to perform a construction without interfering with the passages of people or vehicles in such a way to easily and safely cover a removed pavement section of a road, thus preventing accidents of people or vehicles while obtaining a safe and good construction environment by limiting a vehicle congestion and dust generation. In addition, a reliable construction and a low construction cost used to occur due to a bad earth tramping work can be obtained in the present invention by providing a tramping function, which results in the saving in nations' budgets. The present invention provides an easier transportation and storage along with an easier construction and disassembling and an easier process and a safe and reliable construction.

BACKGROUND ART

A construction generally conducted on a road relates to a new road construction, a maintenance construction cutting and eliminating part or all of a conventional paved road and an excavating construction for burying underground a water and sewage conduit, a gas supply pipe or a communication cable at a road.

In terms of a burying construction of a water and sewage conduit or a gas pipe which is a representative one among many construction types, a road paved with asphalt concrete, concrete, block, etc. is cut by a certain width, and the paved section between the cut sides is removed, thus performing an excavation work. An excavation work is conducted until a certain depth, and sand is poured into the excavated portion and a water and sewage conduit or a gas pipe is buried and a good quality soil is covered thereon to reach a certain height. After that, aggregate is paved to make a freezing prevention layer and a pavement material such as asphalt concrete, concrete or block is paved thereon, thus finishing a pavement restoration work.

In the middle of the earlier-mentioned construction, people or vehicles are guided to walk or run on a section where a paved section is removed for construction or a section where a pavement restoration is not finished while a burial construction of a conduit or a cable is finished. In terms of the current construction method, a safety facility such as a safety fence, a rubber cone, etc. is installed at both sides of an excavated section, and the section where a burial construction is finished is temporarily paved with aggregate to have a height higher than a pavement height before construction, and a temporal material such as a nonwoven fabric and a wooden plate is covered thereon, thus making people or vehicle walk or run thereon. The section where a pavement is removed for construction does not have any safety facilities, so people or vehicles are free to walk or run; however in the earlier mentioned method, a section for a pedestrian passage or a vehicle passage is made narrower, which leads to interfering with the flow of people or vehicles. Since a temporal material can be easily destroyed, the ground can be exposed, thus generating a lot of dusts. The ground might become protruded owing to the subsidence or erosion which generally occurs since people or vehicles repeatedly walk or run thereon or by means of rain, thus causing accidents of people or vehicles. Since the section from which the paved section is removed for construction does not have any safety means, it might be dangerous. The compensation or law suit due to the accidents delays the construction.

The temporal materials such as a nonwoven fabric or a wooden plate are not able to prevent the input of rain in a construction site when it rains, so the water content of the earth increases, which make impossible the ground tramping work. Part of the construction site might be subsided or eroded, thus forming a groove or a water puddle. The earlier-mentioned temporal materials are not good for the safeties of differential settlement sections, and since they are not visually visible at night, the accidents to people or vehicles might accordingly increase.

The temporal materials installed at the removed paved section might be easily torn away as people or vehicle repeatedly walk or runs thereon, so the aggregate or ground surface is exposed, thus generating a lot of dusts. In the event that a long time is needed until the pavement restoration, maintenance works are frequently needed, so over consumption of workers and materials increase, and the construction sites are dirty, which make a city environment look unclean.

The installation of the manhole connecting the underground space and the aboveground space is necessary, which enhances the functions of an underground-buried facility and the maintenance in terms of a variety of road constructions.

In the event of the evacuation work, an evacuation width is determined by considering the kinds of an underground-buried facility such as a water supply conduit and a sewage conduit, the standard and type of a manhole based on the size (diameter) of the underground-buried facility, the burying depth based on the distance from the aboveground, the condition of a road where a burial facility is installed, and a work stability.

The types of the evacuations of the manhole parts are diversified. The cover of the manhole mounted on the top of the manhole is not always mounted at the same position. Its position is determined based on the position and direction of the installation of the manhole, so it is hard to provide a customized cover of the manhole, which causes the lack of a management and a safety measure, thus resulting in more accidents near the manhole. The accident happening near the manhole might bring in a big accident, so a proper measure to such accident is urgently needed.

As described earlier, the aggregate constructed higher than the conventional paved road is needed to be removed depending on the depth of the pavement during the pavement restoration, so the pavement restoration should be performed by paving a pavement material in a state that the ground is fully tramped using equipment such as a roller and a rammer. At this time, the removed aggregate is hard to recycle, thus causing a lot of material consumption. The construction costs a lot since more equipment and workers are provided. In the case of the center of the city, the restoration should be finished within one day. In this case, the pavement restoration costs a lot in the event that the construction section is short, so a construction company might have a lot of financial burden.

Even when the pavement section to be paved is fully tramped, subsidence might occur due to additional tramping work as subsidence naturally occurs or vehicle repeatedly runs on the road after the pavement is finished. In particular, the ground near the cut section of the road is weak for a tramping work, almost construction defects occur at the sections. When a construction defect occurs, additional maintenance is needed, which leads to increasing the cost of construction.

A temporal pavement is performed to reduce the construction defects which occur due to the secondary tramping work. In case of the temporal pavements, since it is needed to remove the temporal pavement materials for a main pavement, a lot of construction wastes occurs, which results in a lot of resource consumptions and environment destruction, thus consuming nation's finance.

DISCLOSURE OF INVENTION

Accordingly, it is an object of the present invention to provide a road restoration block which overcomes the problems found in a conventional road excavation construction in which a lot of safety construction expenses are needed, and a vehicle and pedestrian are hard to pass in a construction section, and a bottle neck phenomenon occurs.

It is another object of the present invention to provide a road restoration block which overcomes the problems found in a conventional art in which non-uniform grooves are formed as the floors easily sink when a cover is constructed using a temporal material such as a nonwoven fabric or a wooden plate at a construction site of a road, so various accidents occur when people or vehicles walk or run on the road.

It is another object of the present invention to provide a road restoration block which overcomes the problems found in a conventional art in which a pass is hard in the event that a construction site of a road is covered using a temporal material such as a to nonwoven material or something, and a city environment is worsened, and the cover is easily torn or damaged, which brings in frequent maintenances, and a lot of dusts occurs as the ground surface is exposed due to the above damages.

It is another object of the present invention to provide a road restoration block which overcomes the problems found in a conventional art in which a penetration of rainwater is not prevented in the event that a construction site of a road is covered using a temporal material such as a nonwoven fabric when it rains, and a water content of the ground increases, so a tramping work is impossible, and a subsidence and a safety problem occur.

It is another object of the present invention to provide a road restoration block which overcomes the problems found in a conventional art in which a temporal material such as a nonwoven fabric or something is not visible at night when people or vehicle pass.

It is another object of the present invention to provide a road restoration block which overcomes the defective construction problems found in a conventional art in which a subsidence occurs due to a defective tramping work under a hard construction condition of a road.

It is another object of the present invention to provide a road restoration block which overcomes the problems found in a conventional art in which there is not provided a proper safety measure at a manhole part of a construction site of a road.

It is another object of the present invention to provide a road restoration block which overcomes the problems found in a conventional art in which a temporal pass is made possible by paving an assistant base layer (aggregate) higher than a conventional paved height for a pass over an excavated section at a construction site of a road, and it is re-excavated during pavement restoration with additional equipment.

It is another object of the present invention to provide a road restoration block which overcomes the problems found in a conventional art in which a lot of waster is produced in the event that a temporal pavement is performed for a pass over an excavated section at a construction site of a road.

To achieve the above objects, there is provided a road restoration block comprising a plurality of blocks which are inter-engaged with each other to cover a road construction site of an excavation construction of a road, thus forming a temporal pavement surface, each block being characterized in that an engaging protrusion is formed at one side for an inter-engagement in a horizontal direction, and an engaging groove is formed at the other side of the same; and a tramping part which is provided at the bottom of each block for tramping the ground of a construction site.

The engaging protrusion is implemented either in a construction that an upper surface of the block body is continuously protruded in a lateral direction, and the engaging grove is so formed in a stepped groove shape so that the engaging protrusion can mount at the opposite side of the block body or in a construction that a lateral central portion of the block body is protruded, and the engaging groove is grooved at the block body of the opposite side of the engaging protrusion.

An engaging shoulder is so formed at both sides of the engaging protrusion that a lengthwise engaging force can be enhanced by engaging the blocks in a horizontal direction, and an engaging groove hooked by the engaging shoulder is formed at a central portion of the engaging groove, and a slipperiness prevention protrusion of the engaging protrusion is formed in a horizontal direction when engaging the blocks, and a slipperiness prevention groove is formed at the engaging groove corresponding thereto.

The block according to the present invention is characterized in that the blocks in upper and lower directions are prevented from disengaging as an engaging protrusion and an engaging groove are engaged so that a subsidence causing non-uniform protrusions at a construction site can be prevented, and the blocks in left and right directions are prevented from disengaging as an engaging shoulder and an engaging groove are engaged, and one block serves to accommodate two different blocks, and the one block also serves to be accommodated by two different blocks, thus producing a strong engaging force, the engaging force of which helps maintain a flat surface at a construction site in which a lot of blocks is installed.

The preset invention is characterized in that an end support block and a length adjustment block are engaged at both sides of a block, thus fully covering a cut surface of a road.

The present invention is characterized in that there is provided an intensive tramping plate protruded in the same direction as a cut surface of a road below an end support block and a length adjustment block which are engaged at both sides of a block.

The present invention is characterized in that there is provided a connection hole into which either a rod or a wire is selectively inserted for an inter-engagement of blocks in a vertical direction.

The present invention is characterized in that a slipperiness prevention protrusion on a surface of a block, the protrusion being selected from between a curved surface and a plane surface.

The present invention is characterized in that a groove is formed in a direction perpendicular to a cut surface of a road, thus guiding the flow of rainwater on the surface.

The present invention is characterized in that a colored or fluorescent material might be coated on a surface of a block for better visibility at night or a night recognition tape or sticker might be attached or a light emitting member such as a LED with a light detection sensor might be inserted into a groove, thus providing better visibility at night, the light detection sensor being designed to operate only at night or during rainy, snowy or cloudy day.

The present invention is characterized in that there is provided a circular or polygonal weight-reducing hole for reducing the weight of the block.

The present invention is characterized in that a manhole block according to the present invention comprises a manhole cover block accommodating a manhole cover support, a manhole slab block having the same outer shape and size as the manhole and accommodating the manhole cover and the manhole cover block, thus covering the top of the manhole slab, and a corner block covering a heteromorphy space formed due to the difference between the straight cover surface and the circular manhole installation surface as a rectangular block is installed.

Advantageous Effects

According to the road restoration block of the present invention, it is light and easy to move and install and disassemble, thus utilizing the same in safe as compared to a conventional road restoration panel (restoration plate) which is hard to move and install and heavy.

According to the road restoration block of the present invention, it is easy to install a disassemble and has a strong engaging force, so it is possible to prevent accidents which might occur due to a subsidence, in such a way to cover a non-uniform road surface of a road construction site in a flat shape, and the present invention provides an easier night recognition function, thus allowing people or vehicle to pass in safe.

According to the road restoration block of the present invention, a good construction site can be made by covering a road construction site, and people living near a construction site might not suffer from flying dusts by preventing dusts, thus obtaining an environmentally friendly work site.

According to the road restoration block of the present invention, a customized cover welling fitting the positions of a manhole and a manhole cover is provided, so a manhole and a manhole cover can be managed in safe during a construction, which allows people or vehicle to pass in safe.

According to the road restoration block of the present invention, it does not need to remove an existing material during a pavement restoration in such a way that a construction site of a road is guided to naturally subside by covering the construction site for a long time, so the ground is fully tramped by people and vehicle passing over the construction site. Equipment such as a roller or a rammer is not needed. Since a pavement material (asphalt concrete or block can be directly paved on the ground which is well tramped, material consumptions can be prevented, and construction does not cost a lot. An intensive care for a weakly tramped site is possible, and the construction quality can be greatly enhanced in the resent invention.

BRIEF DESCRIPTION OF DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Modes for Carrying out the Invention

Figure 1:
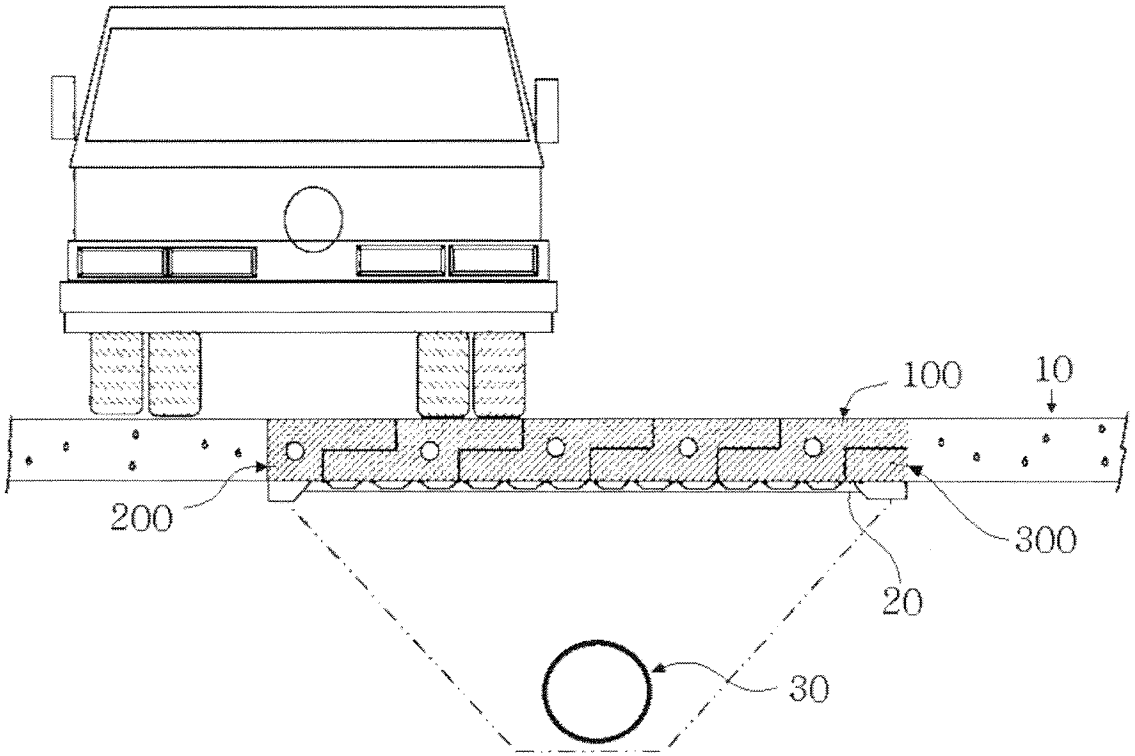
FIG. 1 is a cross sectional view of a use state of a road restoration block according to the preset invention.

The preferred embodiments of the present invention will be described in details with reference to the accompanying drawings.

The present invention is directed to providing a plurality of blocks 100 which are engaged with each other and form a temporal pavement surface while covering a road construction site of a variety of excavation constructions of a road. Each block 100 is characterized in that an engaging protrusion 130 is formed at its one side for an inter-engagement in a horizontal direction, an engaging groove 140 formed at the other side, and a tramping part 400 which is disposed at the bottom of the same for a ground tramping of a construction site.

Figure 4:
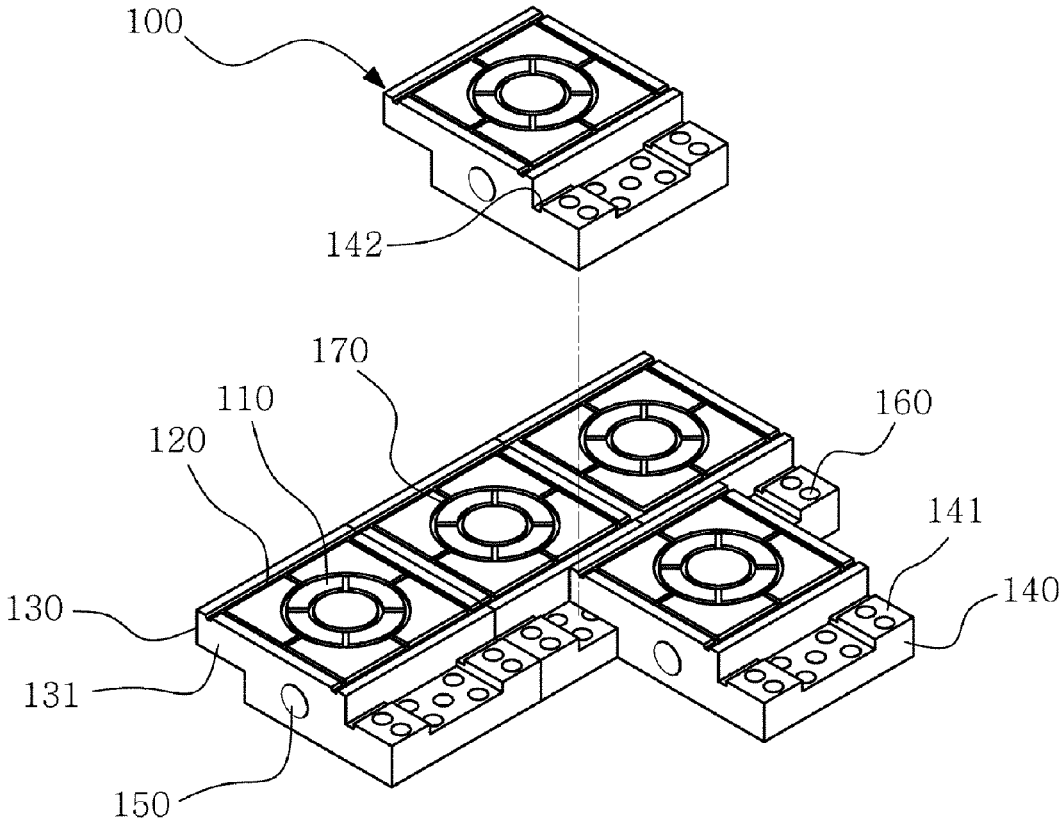
FIG. 4 is a perspective view illustrating the top of a road restoration block of FIG. 2.
Figure 5:
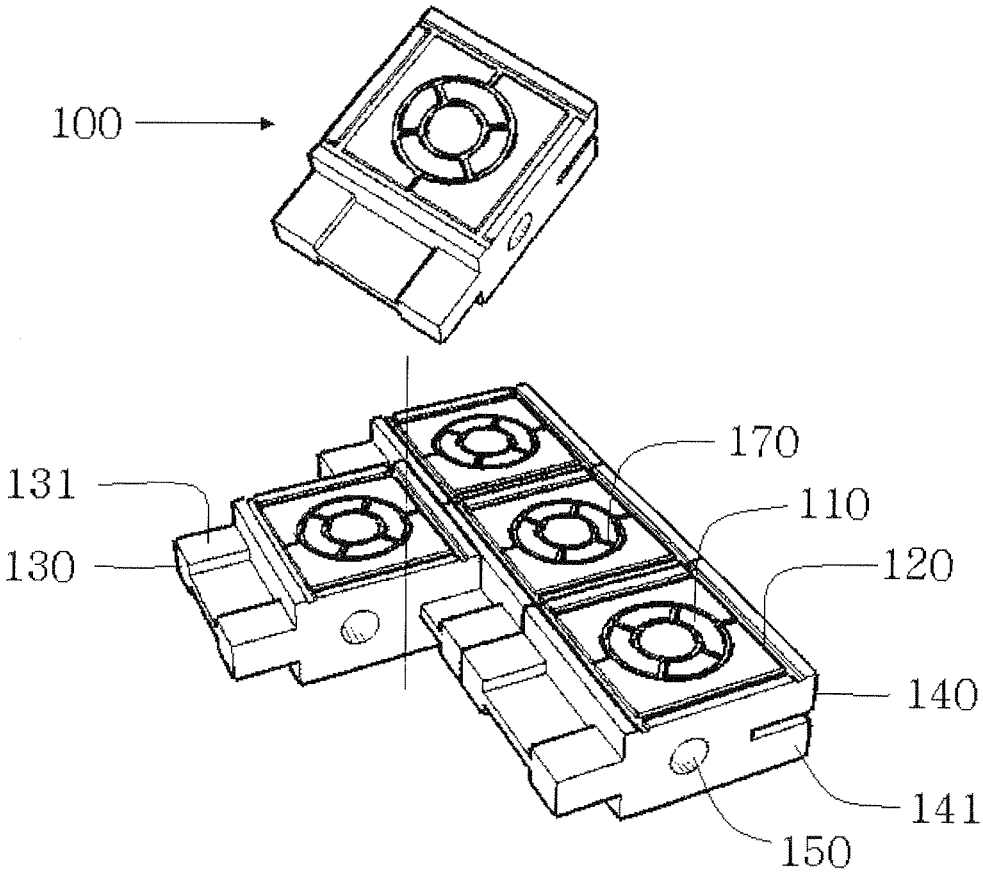
FIG. 5 is a perspective view illustrating the top of a road restoration block of FIG. 3.
Figure 6:
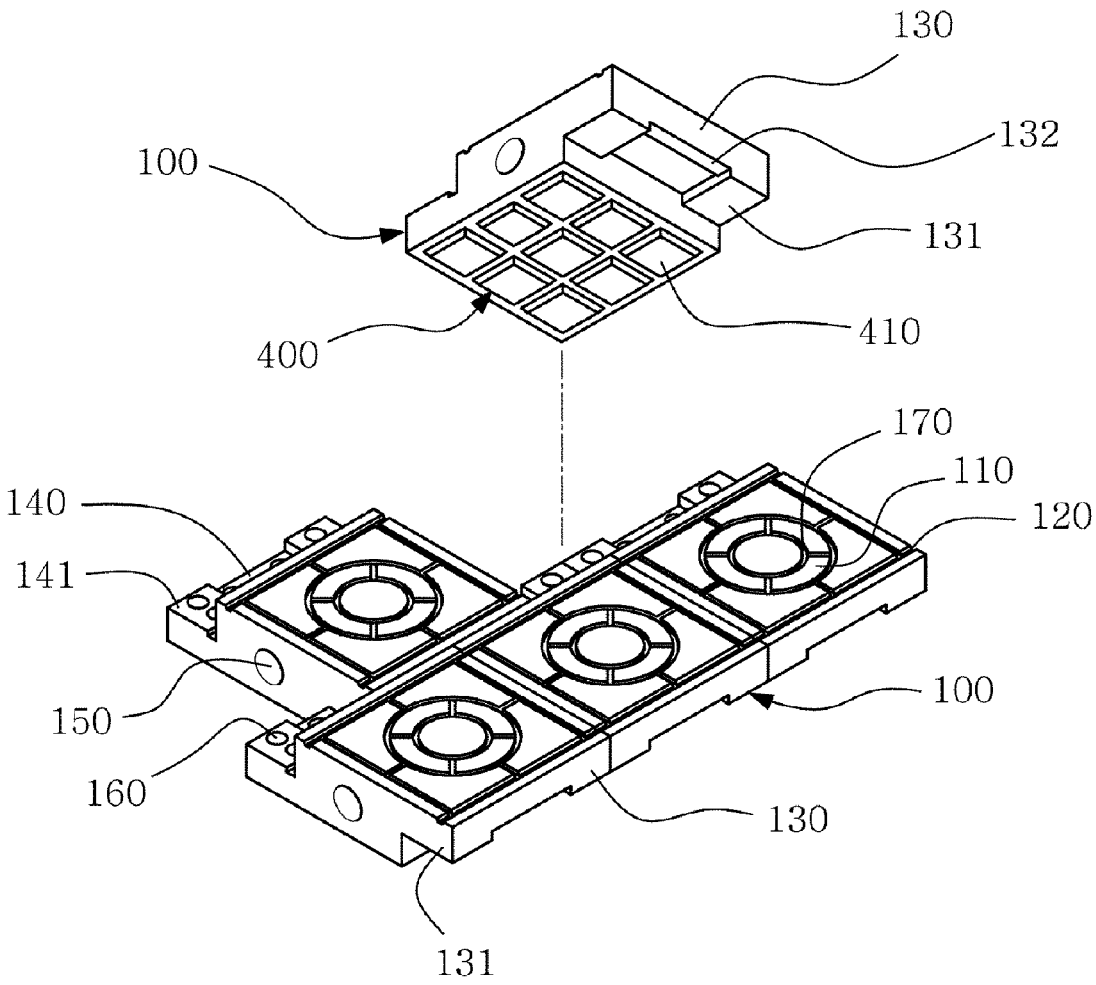
FIG. 6 is a perspective view illustrating the bottom of a road restoration block of FIG. 2.
Figure 7:
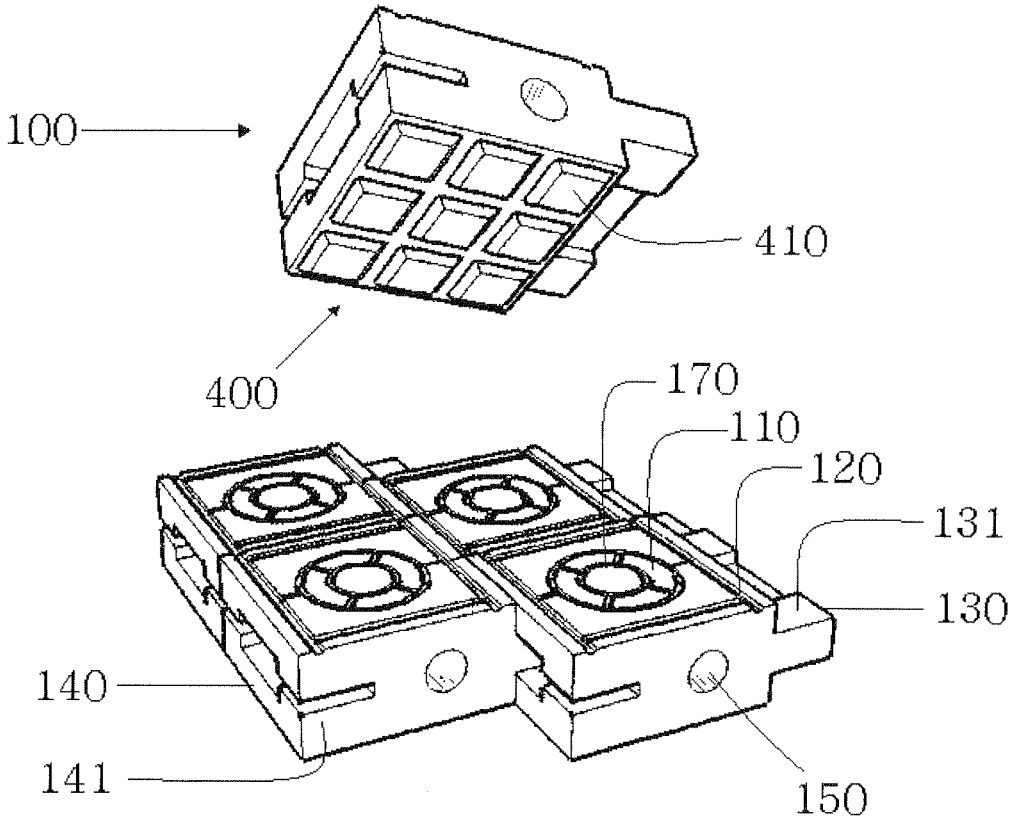
FIG. 7 is a perspective view illustrating the bottom of a road restoration block of FIG. 3.
Figure 8:
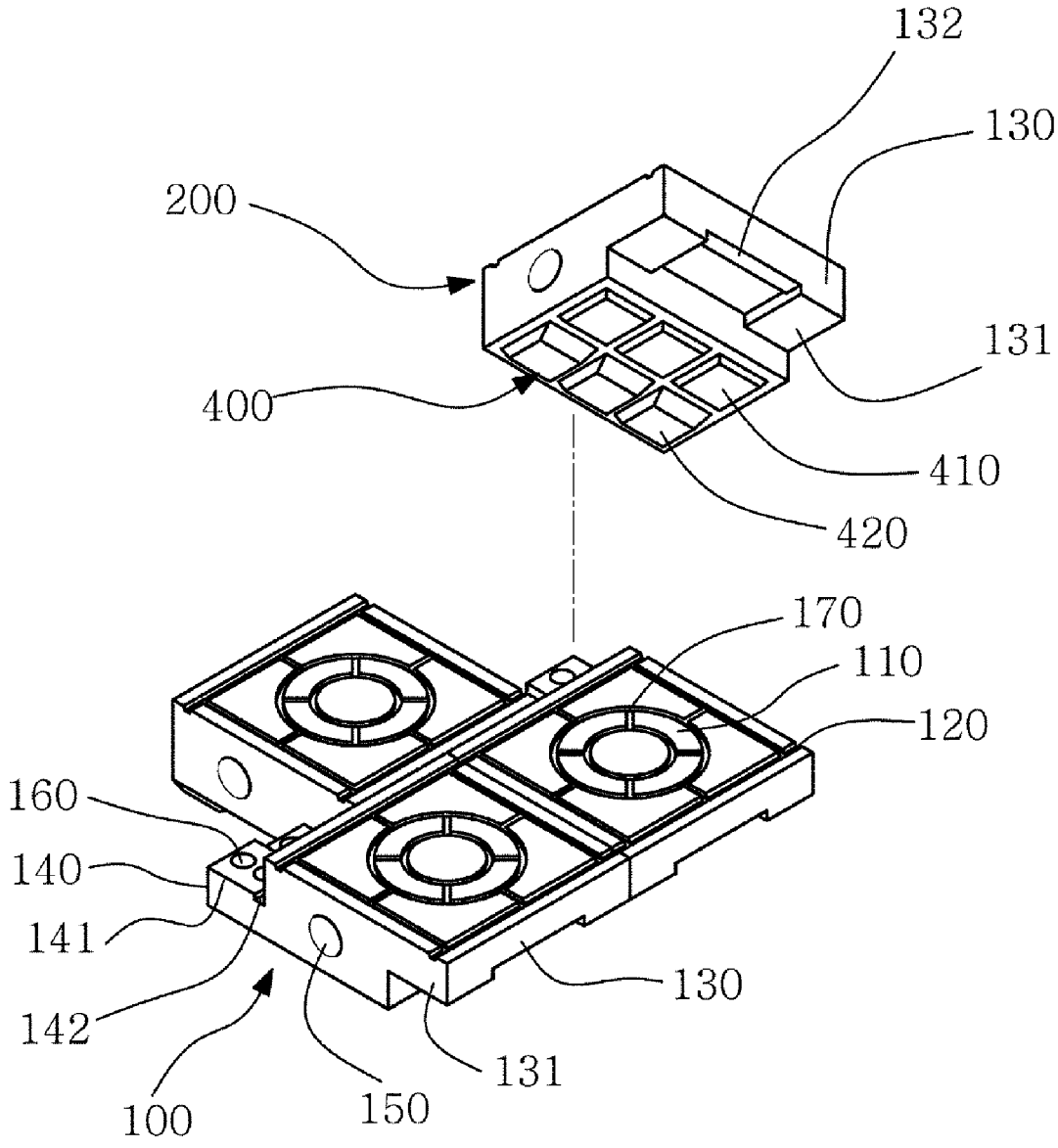
FIG. 8 is a perspective view illustrating a major portion of a road restoration block of FIG. 2.
Figure 9:
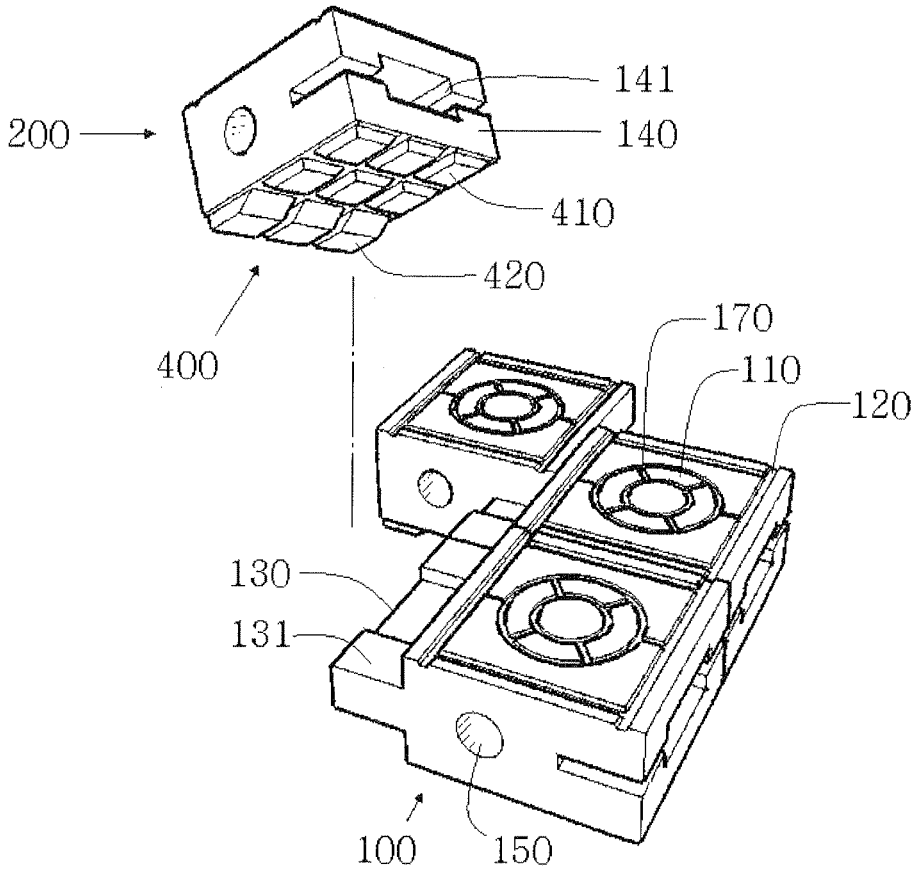
FIG. 9 is a perspective view illustrating a major portion of a road restoration block of FIG. 3.
Figure 10:
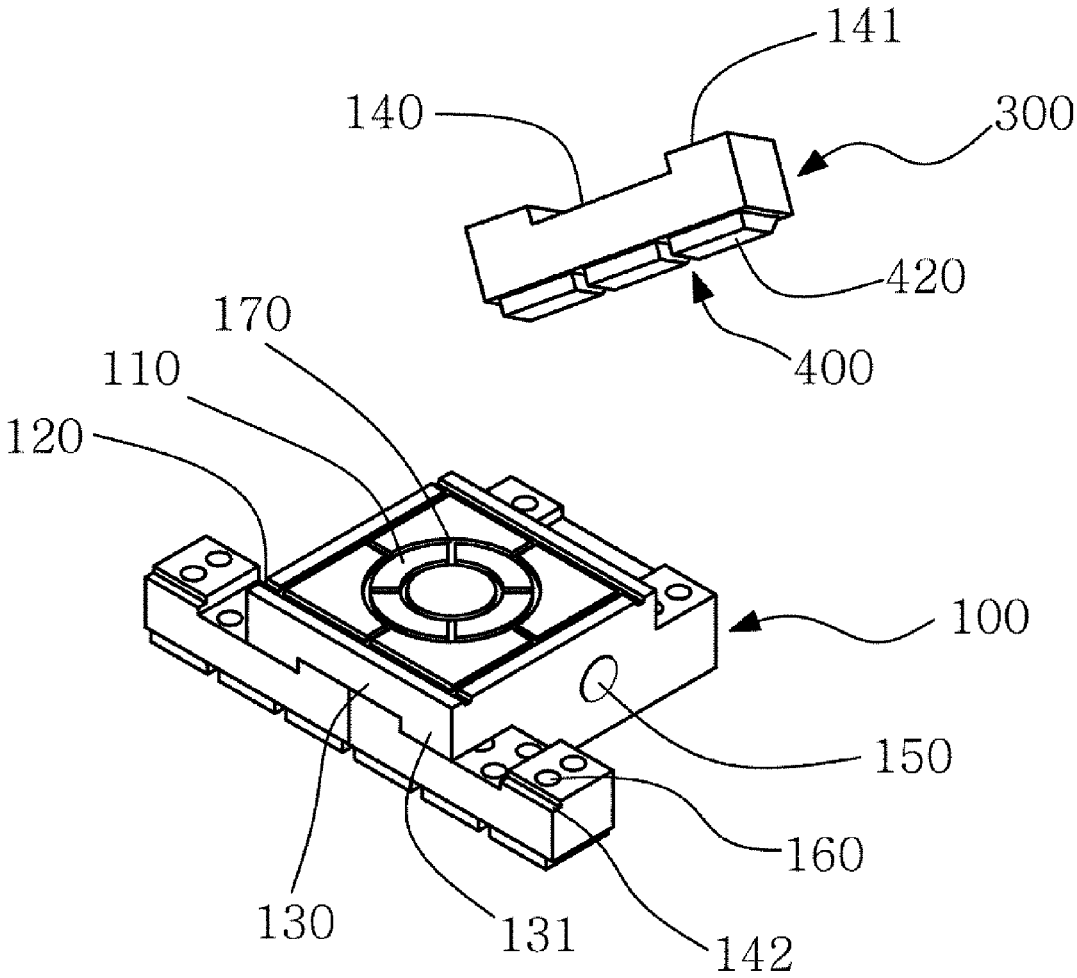
FIG. 10 is a perspective view illustrating a major portion of a road restoration block of FIG. 2.
Figure 11:
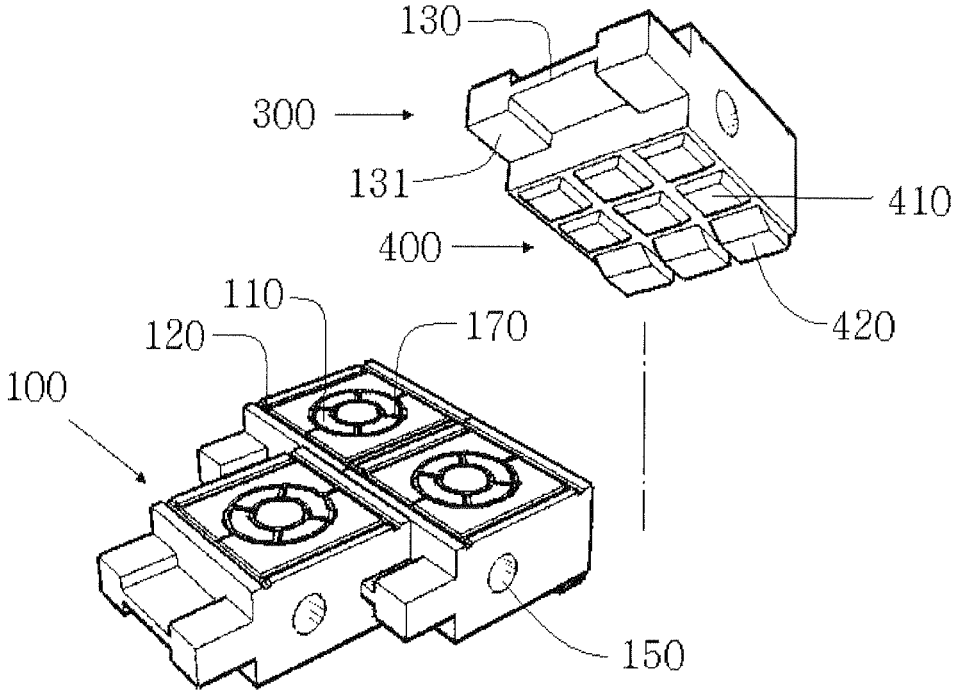
FIG. 11 is a perspective view illustrating a major portion of a road restoration block of FIG. 3.

The block 100 is formed of an engaging protrusion 130 formed along a widthwise direction of a removed pavement surface as shown in FIGS. 4 and 5 and an engaging groove 140 engaged with the same as shown in FIGS. 6 and 7, with at least two blocks 100 being connected in the upper and lower directions or the left and right directions, respectively.

Figure 2:
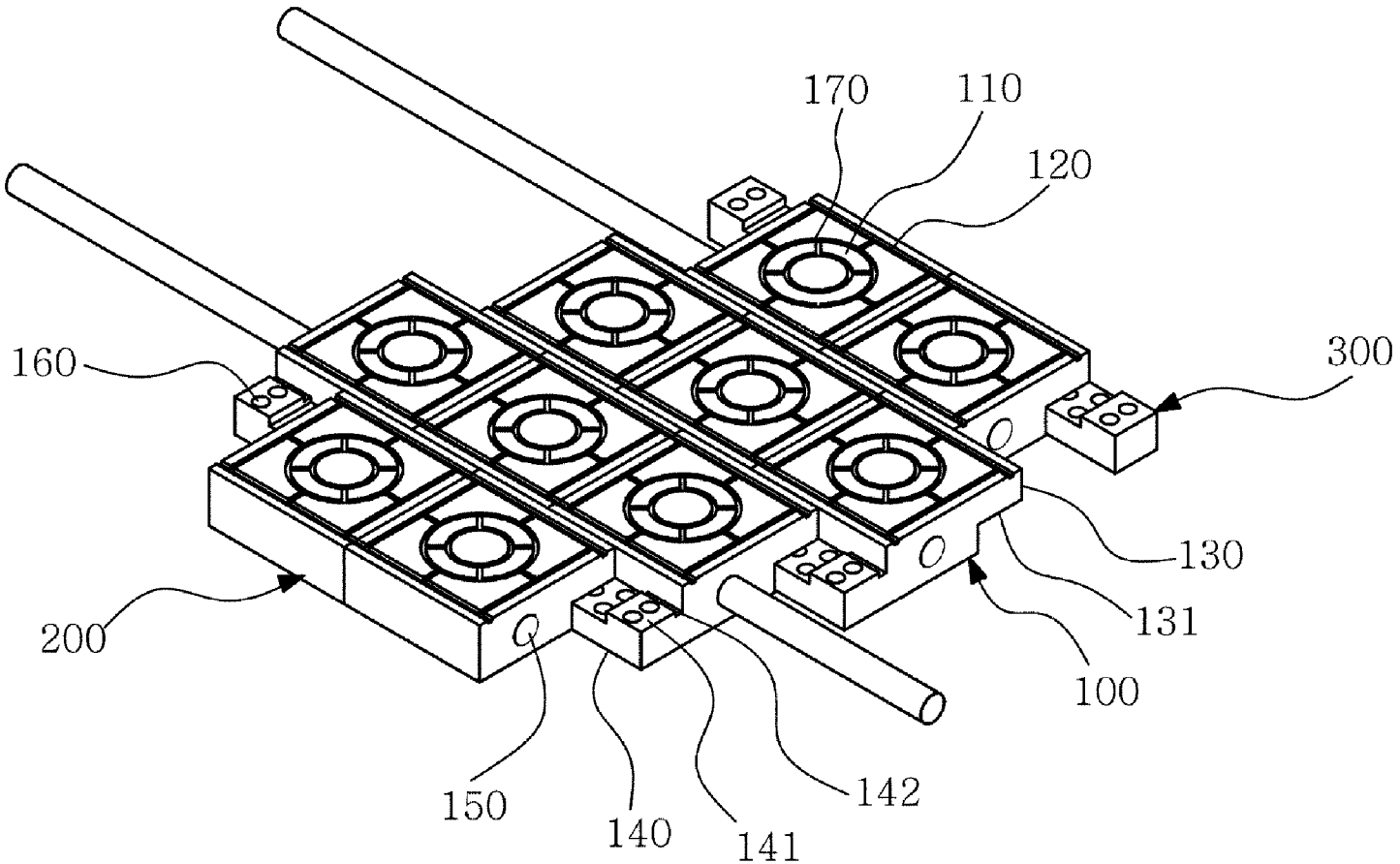
FIG. 2 is a perspective view illustrating a road restoration block according to an embodiment of the present invention.
Figure 3:
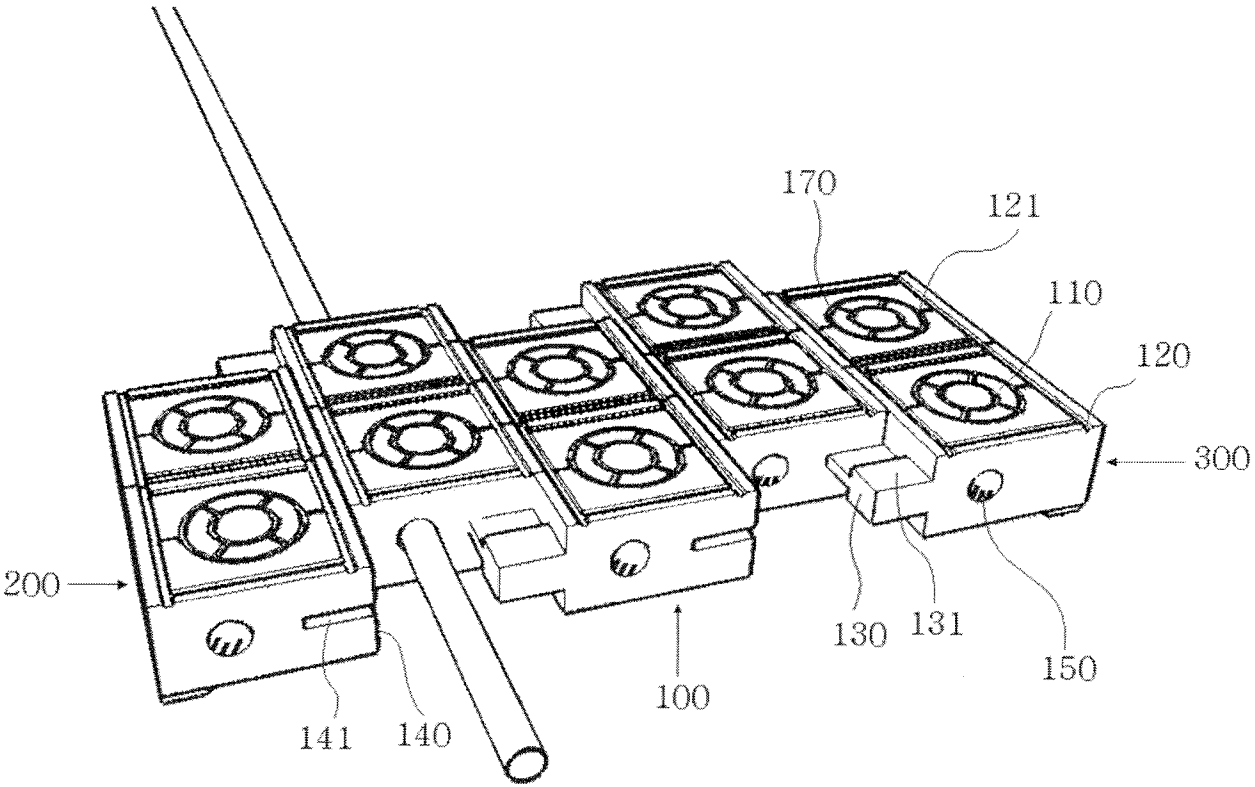
FIG. 3 is a perspective view illustrating another road restoration block according to an embodiment of the present invention.

When engaging the blocks 100 in a horizontal direction, they are engaged in a zigzag shape. An engaging shoulder 131 is formed at both sides of the engaging protrusion 130 for enhancing a lengthwise engaging force, and an engaging groove 141 hooked by the engaging shoulder 131 is formed at a central portion of the engaging groove 140. As shown in FIGS. 2 and 3, each block is engaged in the upper and lower directions without any movements between them. There are provided an end support block 300 supporting the end portion, and a length adjusting block 200 corresponding to the width of the removed pavement surface, thus fully covering the removed pavement surface in a widthwise direction.

In order to engage the blocks 100 in a vertical direction, a rod or a wire is selectively inserted, and a connection hole 150 is formed to install therein an electric power supply cable 920.

When engaging the blocks 100, a slipperiness prevention protrusion 132 of an engaging protrusion 130 is provided so as to prevent slipperiness in a horizontal direction, and a slipperiness prevention groove 142 is formed at the engaging groove 140 corresponding thereto.

The blocks 100 are mounted on the ground of a construction site of a road, thus supporting when people or vehicles pass. As shown in FIGS. 2 and 3, a slipperiness prevention protrusion 110 is formed on the surface, thus preventing slipperiness when people or vehicles pass.

As shown in FIGS. 2 and 3, left and right rainwater grooves 121 are formed on the surface of each block 100, thus guiding the rainwater of the surface of the block 100 in left and right directions. When the blocks 100 are connected in upper and lower directions or left and right directions, the right angle direction rainwater grooves 120 formed at a right angle with respect to the cut surface of the road are interconnected, so rainwater of the road with the blocks 100 installed is guided to flow in the excavation direction.

As shown in FIGS. 4 and 5, a night recognition colored material and a fluorescent material is coated on the surface of each block 100 or a night recognition tape and a stocker might be attached. A light emitting member 900 such as a LED or something might be inserted into a light emitting groove 170, which helps enhance visual recognitions at night.

Figure 14:
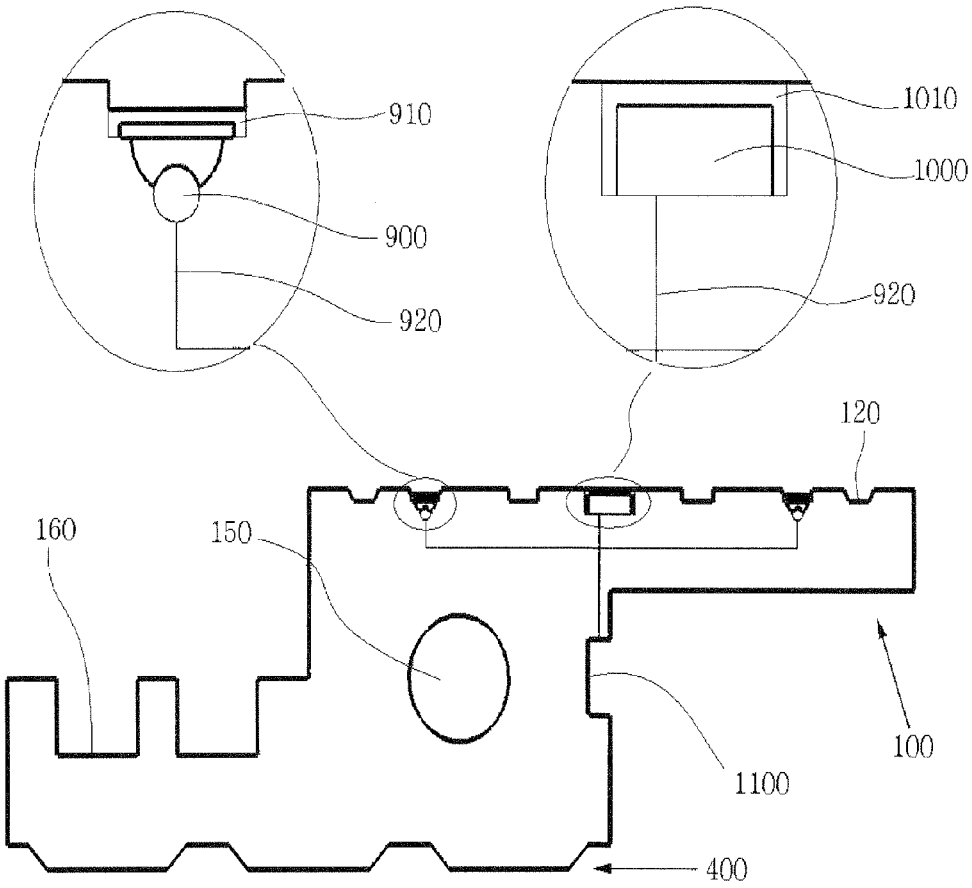
FIG. 14 is a cross sectional view of a road restoration block of FIG. 2 according to another embodiment of the present invention.

The light emitting member 900 such as a LED or something inserted into the surface of the block 100, as shown in FIG. 14, might be designed to operate only at night or rainy, snowy or cloudy day by attaching a light detection sensor 1000 by receiving an electric power from an electric power part 1100 connected with a secondary battery or a cable. A light emitting part protection cover 910 is provided at the upper surface of the light emitting part 900 for protecting the same. A sensor protection cover 1010 might be provided at the upper surface of the light detection sensor 1000 for protecting the same from damages.

In the drawings, reference numeral 92 represents an electric power supply cable.

As shown in FIG. 2, at least one self-weight reducing hole 160 is formed at each block 100 while not affecting to its functional structure, thus reducing the weight of the block 100.

Figure 12:
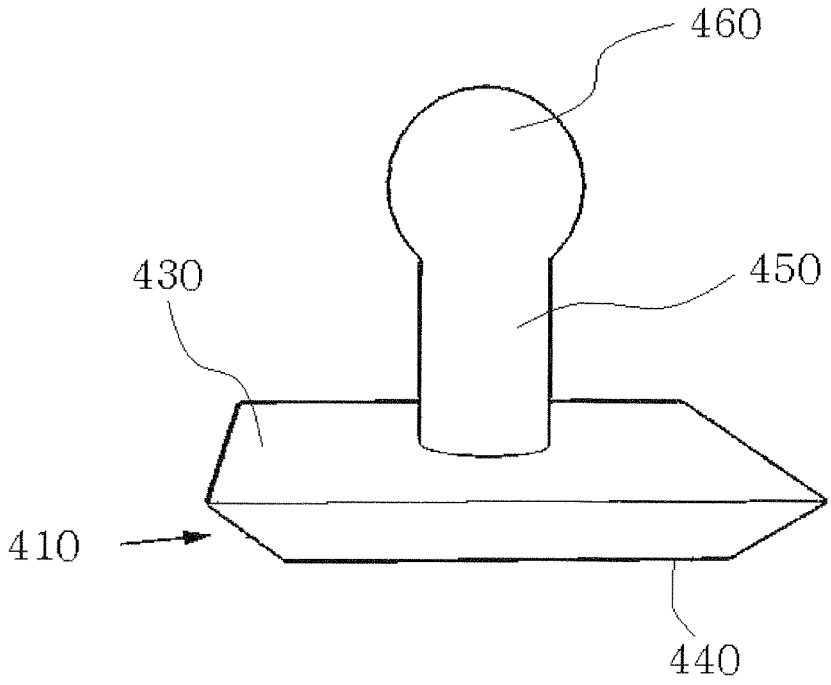
FIG. 12 is a cross sectional view illustrating a road restoration block of FIG. 2 or FIG. 3 according to another embodiment of the present invention.
Figure 13:
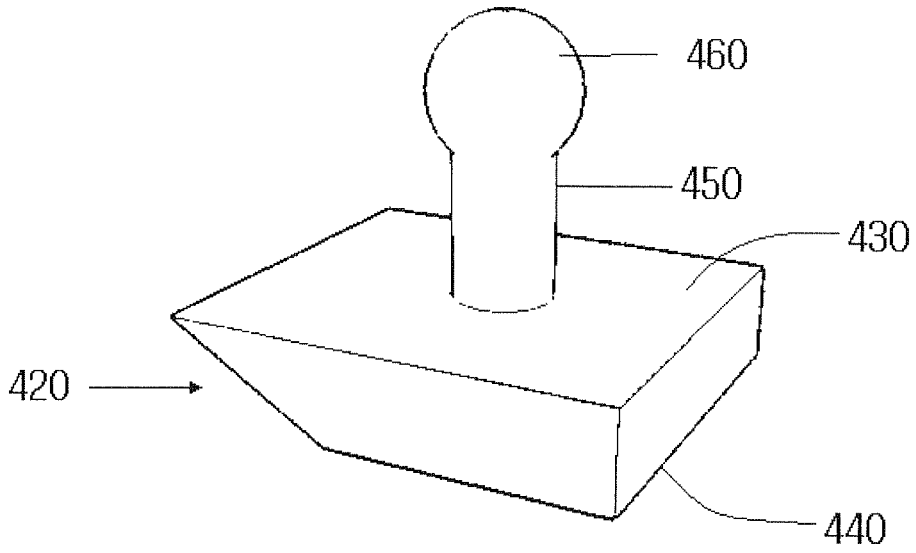
FIG. 13 is a perspective view illustrating a road restoration block of FIG. 2 or FIG. 3 according to another embodiment of the present invention.

As shown in FIGS. 6 and 7, at the bottom of the block 100 is formed a tramping part 400 formed of at least one tramping plate 410 in which a tramping plate upper side 430 coming into contact with the block 100 and a tramping plate lower side 440 having a downsized construction as compared to the tramping plate upper side are formed in a cone shape or a column shape. The tramping plate 410 of the tramping part 400 might be integral with the block 100 or as shown in FIGS. 12 and 13 might be formed in such a manner that a circular or polygonal tramping plate 410 working like the tramping part 400 is engaged with the lower side of the block 100.

In case of the tramping part 400 engaged to the lower sides of the length adjusting block 200 and the end support block 300 engaged to the end of the block 100, respectively, since the tramping work is not properly performed at the portion, an intensive tramping plate 420 protruded in the same direction as the cut surface of the road is engaged, thus improving the weak tramping. The tramping part 400 is formed of a rectangular tramping to plate 410, and the rectangular tramping plate 410 and the intensive tramping plate 420 are detachably engaged to the lower side of the block 100. A tramping plate support part 450 is protruded from the tramping plate upper side 430, and a disengagement prevention protrusion 460 is formed at an end of the tramping plate support part 450 for thereby preventing disengagement from the tramping groove formed at the block 100. The tramping plate lower side 440 is formed in a rectangular shape or a circularly protruded shape.

Figure 15:
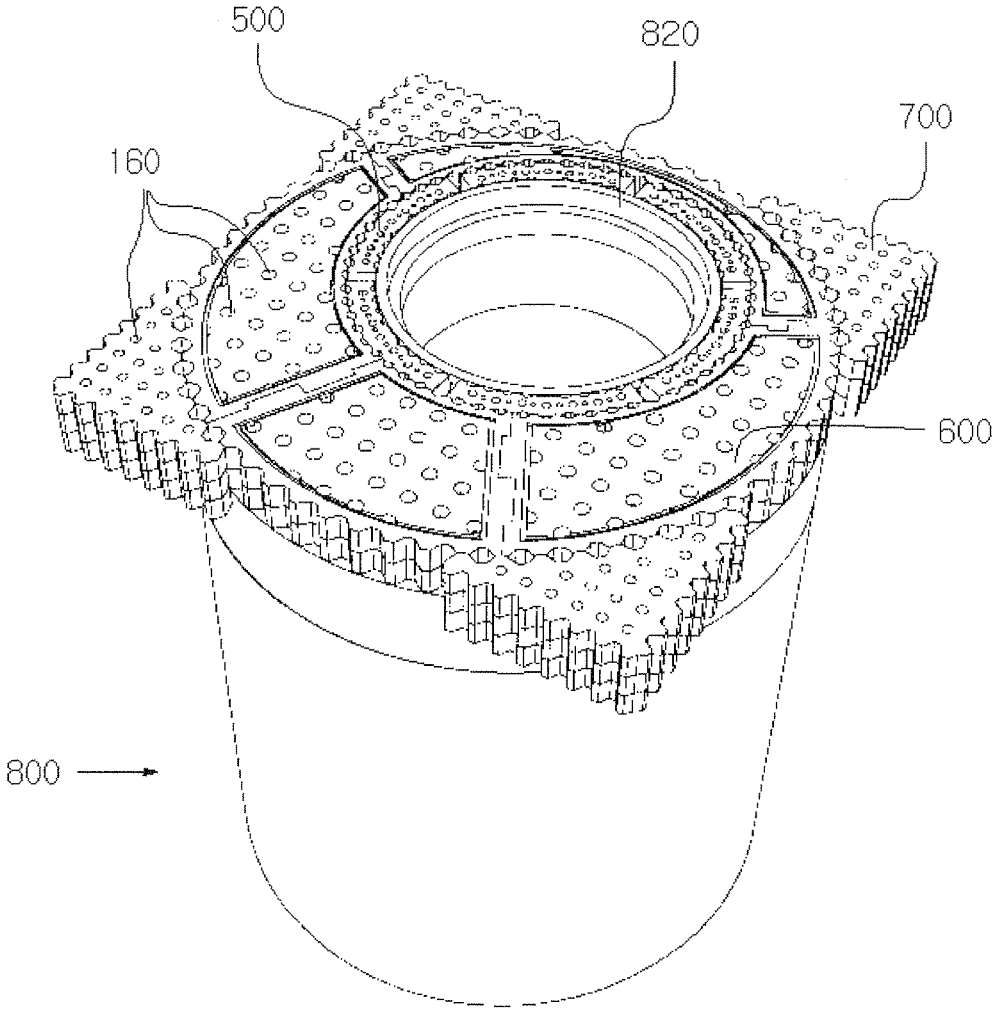
FIG. 15 is a cross sectional view illustrating a use sate of a road restoration block according to another embodiment of the present invention.
Figure 16:
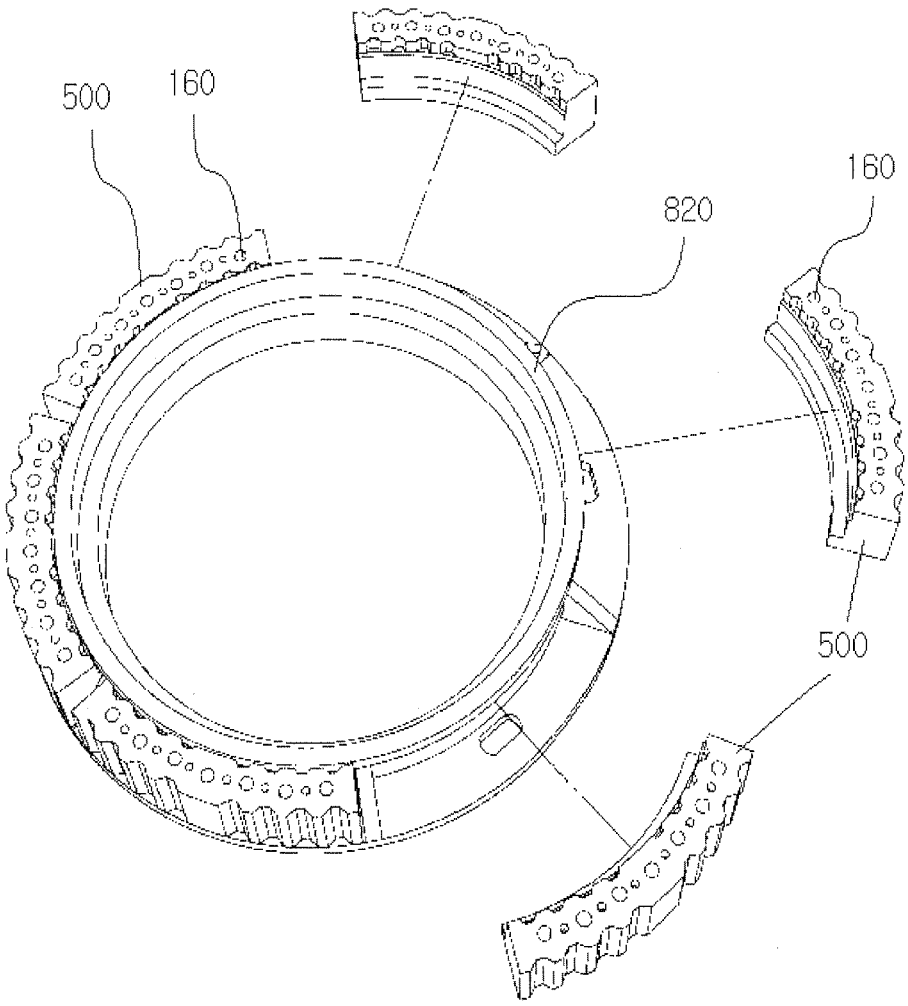
FIG. 16 is a perspective view illustrating a major portion of a road restoration block of FIG. 15.

As shown in FIG. 15, in the event of the road construction site where there is a manhole 800, as shown in FIG. 16, at least one space filling block 500 is formed in the same shape as the manhole cover rest at the manhole cover support 820 as long as the manhole cover 810 is provided.

Figure 17:
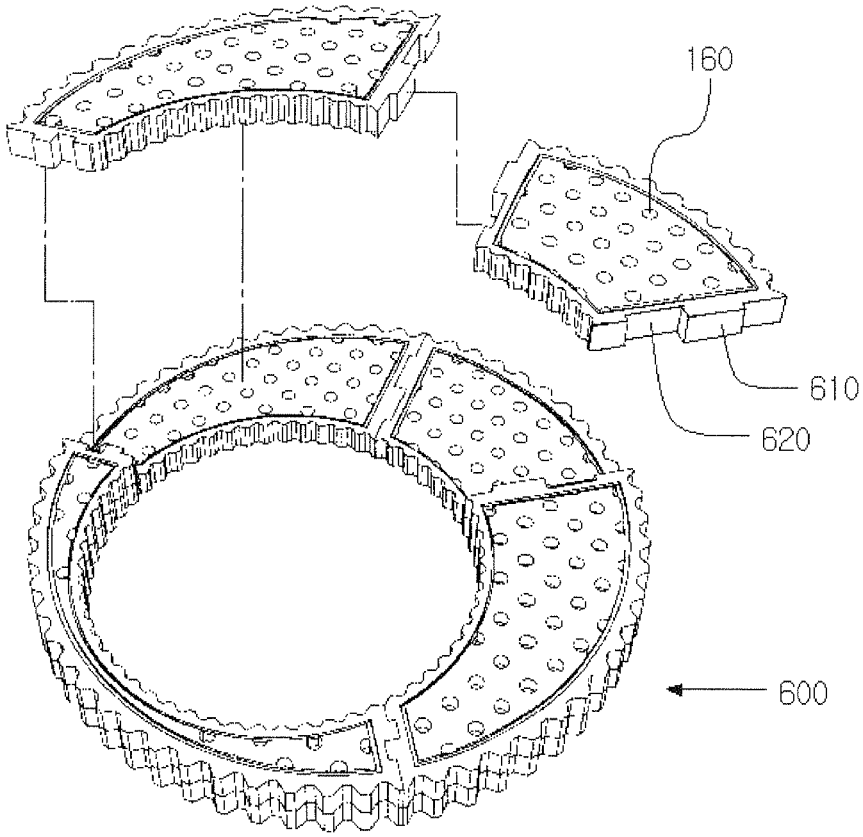
FIG. 17 is a perspective view illustrating a major portion of a road restoration block of FIG. 15.
Figure 18:
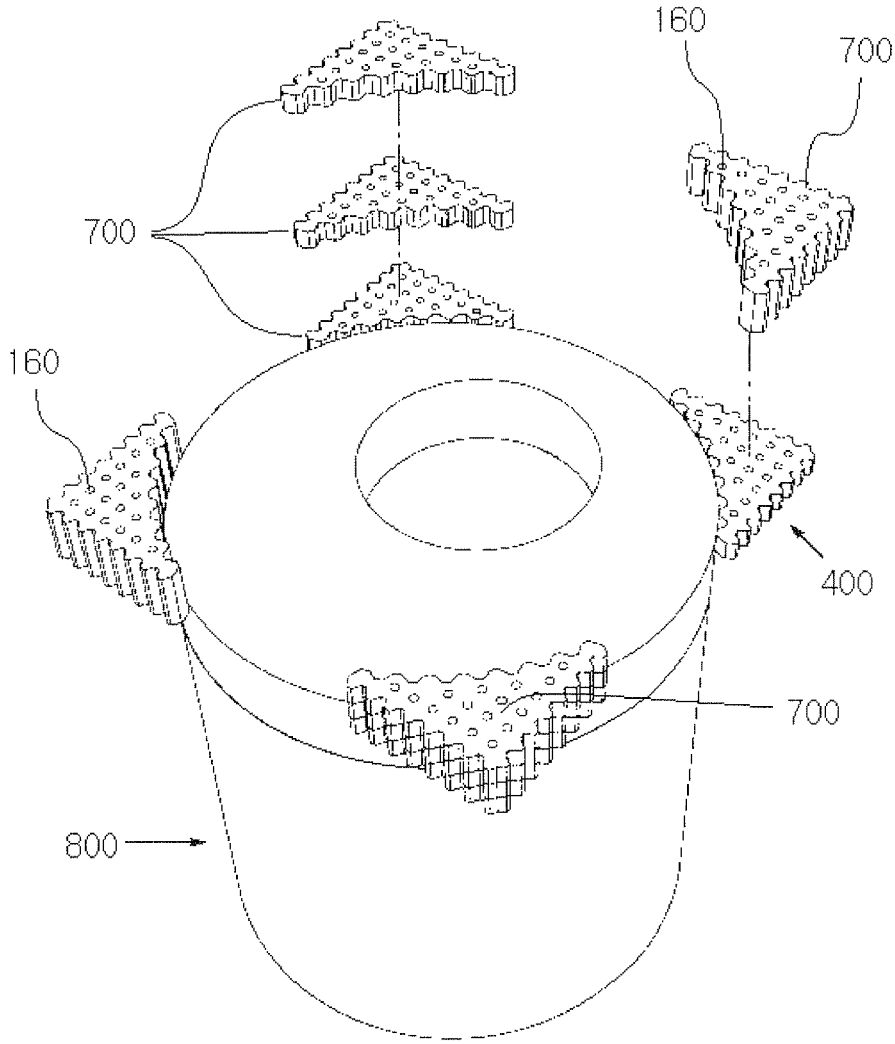
FIG. 18 is a perspective view illustrating a major portion of a road restoration block of FIG. 15.

As shown in FIGS. 15 through 17, a manhole slab block 600 having the same size as the circumference of the manhole is provided, thus fully covering the top of the manhole slab while accommodating the manhole cover at a certain angle irrespective of the position of the manhole cover.

As shown in FIGS. 15 through 18, a corner block 700 is formed at a corner of an outer side of the manhole so as to cover a heteromorphy space formed as the straight block is engaged with the circular manhole, thus fully covering the manhole of the construction site.

The filling block 500, the slab block 600 and the corner block 700 are formed in to the same shapes as the sizes of the margins varying depending on the sizes of the manhole 800 and are formed in at least one layer. They might be split into at least one piece, thus forming a protruded insertion protrusion 610 and a concave shaped insertion groove 620 at one side of each block, with the protruded insertion protrusion 610 and the concave shaped insertion groove 620 being engaged with each other, and at least one weight reducing hole 160 is formed.

In particular, a tramping part 400 is selectively formed at the bottom of the corner block 700 so as to tramp the ground near the manhole 600 which is weak to tramp.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A road restoration block, comprising:

a plurality of blocks which are inter-engaged with each other to cover a road construction site of an excavation construction of a road, thus forming a temporal pavement surface, each block configured in such a way that an engaging, protrusion is formed at one side for an inter-engagement in a horizontal direction, and an engaging groove is formed at the other side of the same; and a tramping part which is provided at the bottom of each block for tramping the ground of a construction site, wherein the engaging protrusion is configured either in a construction that an upper surface of the block body is continuously protruded in a lateral direction, and the engaging groove is so formed in a stepped groove shape so that the engaging protrusion can mount at the opposite side of the block body or in a construction that a lateral central portion of the block body is protruded, and the engaging groove is grooved at the block body of the opposite side of the engaging protrusion, and an engaging shoulder is so formed at both sides of the engaging protrusion that a lengthwise engaging force can be enhanced by engaging the blocks in a horizontal direction, and an engaging, groove hooked by the engaging shoulder is formed at a central portion of the engaging groove, and an intensive tramping plate protruded in the same direction as the direction of a road cut surface is formed at the lower sides of the end support block and the length adjusting block which are engaged at both sides of the block, and a slipperiness prevention protrusion of the engaging protrusion is formed in a horizontal direction when engaging the blocks, and a slipperiness prevention groove is formed at the engaging groove corresponding thereto.

2. The road restoration block of claim 1, wherein there is provided a connection hole into which either a rod or a wire is selectively inserted for an inter-engagement in a vertical direction, and an end support block and a length adjusting block are engaged at both sides of each block, thus fully covering a road cut surface.

3. The road restoration block of claim 1, wherein said each block has a slipperiness prevention protrusion formed at its surface in either a curved shape or a plane shape, and said block has a groove vertical with respect to a road cut surface, thus guiding the flow of rainwater, and said block is formed in either a construction that a fluorescent material is coated at its surface for an easier recognition at night or a construction that a light emitting part with a light detection sensor is attached, with the light detection sensor being, designed to operate at night or on rainy, snowy or cloudy days, and a weight reducing hole is formed for a self-weight reduction of the block.

* * * * *